US005766729A

United States Patent [19]

Zanchetta et al.

[11] Patent Number: 5,766,729

[45] Date of Patent: Jun. 16, 1998

[54] BITUMEN-BASED MEMBRANE WITH SEALING MEANS FOR CONTIGUOUS MEMBRANES AND RELEVANT PROCESSING SYSTEM

[75] Inventors: Luigi Zanchetta; Romano Zanchetta, both of Negrisia, Italy

[73] Assignee: Polyglass S.p.A., Treviso, Italy

[21] Appl. No.: 384,899

[22] Filed: Feb. 7, 1995

[30] Foreign Application Priority Data

Mar. 1, 1994 [IT] Italy ..... MI94A0373

[51] Int. Cl.[6] ..... E04D 1/26; B32B 3/06

[52] U.S. Cl. ..... 428/143; 428/150; 428/40.3; 428/195; 428/192; 428/193; 428/196; 442/48; 442/85; 442/180; 442/282; 442/321; 52/528; 52/519

[58] Field of Search ..... 428/143, 150, 428/40.3, 228, 251, 195, 192, 193, 196; 442/48, 85, 180, 282, 321; 52/528, 519

[56] References Cited

U.S. PATENT DOCUMENTS 5,082,704 1/1992 Higgins ..... 428/40

5,143,766 9/1992 Wenz et al. ..... 428/40

5,206,068 4/1993 Kalkanoglu ..... 428/143

*Primary Examiner*—William Watkins

*Attorney, Agent, or Firm*—Baker & McKenzie

[57] ABSTRACT

A bitumen-based waterproofing membrane is provided with an improved edge for sealing with a contiguous membrane to provide a membrane system with improved waterproofing characteristics. A bitumen-based reinforced membrane sheet is coated with granular material to protect the membrane sheet from ultraviolet rays. However, a section of the membrane sheet is first covered with a piece of protective tape which prevents any granular material from being deposited on the lateral section of exposed bitumen beneath the tape. The membrane sheets are then cut immediately prior to the tape or at the edge of the granular coating and then rolled up. Accordingly, the lateral section of bitumen which is covered by the protective tape is on the innermost part of the rolled-up membrane sheet. During installation, the tape is removed and the exposed bitumen or selvage section is disposed below an adjacent or contiguous membrane. Heat is then applied for an easy and effective seal between two adjacent membrane sheets.

8 Claims, 2 Drawing Sheets

BITUMEN-BASED MEMBRANE WITH SEALING MEANS FOR CONTIGUOUS MEMBRANES AND RELEVANT PROCESSING SYSTEM

FIELD OF THE INVENTION

This invention is related to waterproofing membranes and more specifically to bitumen-based membranes with sealing means for contiguous membranes, as well as the relevant processing system for fabricating the same.

BACKGROUND AND SUMMARY OF THE INVENTION

Bitumen-based membranes are used for waterproofing in construction. Such membranes normally feature a reinforcement made of non-woven polyester cloth or of a layer of reinforced glass such as fiberglass. One of the membrane surfaces is coated with small slate flakes of various colors, similar to granules, for protection against ultraviolet rays.

The users of these types of membranes currently face serious problems when trying to seal together contiguous membranes because of the relatively complex steps that must be carried out to connect the two contiguous or adjacent ends. Of course, if an effective seal is not attained, the membrane system will leak and not achieve its very purpose.

The purpose of this invention is to solve the above mentioned problem by creating a bitumen-based membrane with sealing means that make it possible to connect continuous membranes quickly and effectively with reduced energy consumption and excellent results.

Within the above described scope, one of the goals of the invention is to provide membranes that are impermeably sealed to adjacent or contiguous membranes in an effective and aesthetically pleasing manner.

The bitumen-based membrane that is the subject of this invention provides a reliable seal between membranes because of its unique design features.

The subject bitumen-based membrane is easy to produce because it is made of elements and materials that are available on the market. Further, the membrane of the present invention is relatively inexpensive to manufacture and install.

The task described above, the goals mentioned, as well as additional goals—which will be described hereinafter—have been achieved with a bitumen-based membrane featuring sealing means for contiguous membranes, per this invention, which consists of the following:

A bitumen-based membrane sheet, developed longitudinally, which is reinforced with a polyester non-woven cloth or with a coat of reinforced glass on one side of said membrane sheet.

One side of the membrane sheet will be coated with granular material such as small slate flakes. Said membrane sheet is characterized by the fact that it includes, at least at one of its ends, a transverse selvage which consists of a tract of exposed bitumen, free of granular material, as well as of a thin coat of polyethylene which, when heated, seals the ends of contiguous membranes together.

BRIEF DESCRIPTION OF THE DRAWINGS

Additional characteristics and advantages, which are offered by the subject invention, will be pointed out while examining one of the preferred production methods, although not the sole method, of a bitumen-based membrane as well as its processing system, which is illustrated by way of example—but not exclusively—through the enclosed drawings, where.

DETAILED DESCRIPTION OF THE DRAWINGS

Figure 3:
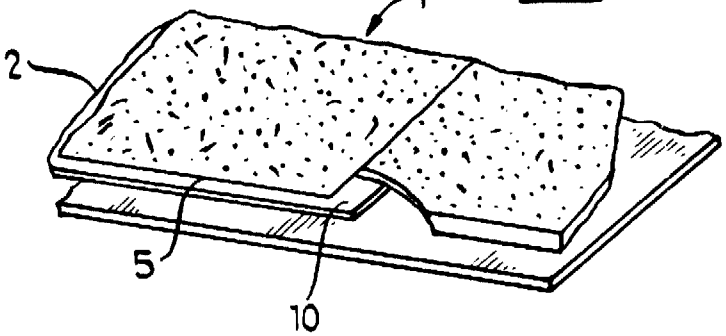
FIG. 3 schematically illustrates the membrane at the point where it is coupled to another membrane.

With reference to FIG. 3, the bitumen-based membrane includes a sheet/slab-like element 2, which is longitudinally developed and bitumen-based. The element 2 is modified with polyester and reinforced with polyester non-woven cloth 4 (see FIG. 1) or with a thin coat of reinforced glass.

One side of the sheet/slab-like element is coated with granular material such as small slate flakes of various colors (see FIG. 1), which creates a granular-type surface for protecting the sheet/slab-like element from the ultraviolet rays.

An additional benefit is the application of a transverse selvage 10. This invention is unique in that a transverse selvage 10 is placed on at least one end of the sheet/slab-like element. This provides an area free of detaching material, such as sand or talcum, as well as of slate granules.

The tape, or band 11—made of siliconized polyester—on tract 10 needs to be removed before installation.

The protective tape, or band 11 assures that at the time of installation the surface of the membrane is clean and free of slate granules, of detaching material, of any polyethylene to scorch or of any other material usually employed for packaging the rolls of membrane in order to avoid that the turns adhere to each other during storage.

The new membrane, prepared in the above described manner, reduces the time of installation and, consequently, labor costs and gas consumption. Additionally, it achieves stronger bonding between the two leading edges.

Also, the width of the selvage 10 is preferably constant, predetermined based on the set value, and it is generally orthogonal with respect to the length of the roll.

Also this factor helps installation, helps in achieving a consistent layout of the sheets; furthermore, it allows the user to achieve an impermeable and sealed surface that is more effective and more aesthetically pleasant.

Additionally, the protective tape 11 (see FIG. 1) which covers the selvage 10 assures that the surface of the roll, which is coated with small slate flakes, does not come in contact with the modified bitumen, thus preventing the selvage 10 from becoming "soiled", which would render it ineffective.

Figure 1:
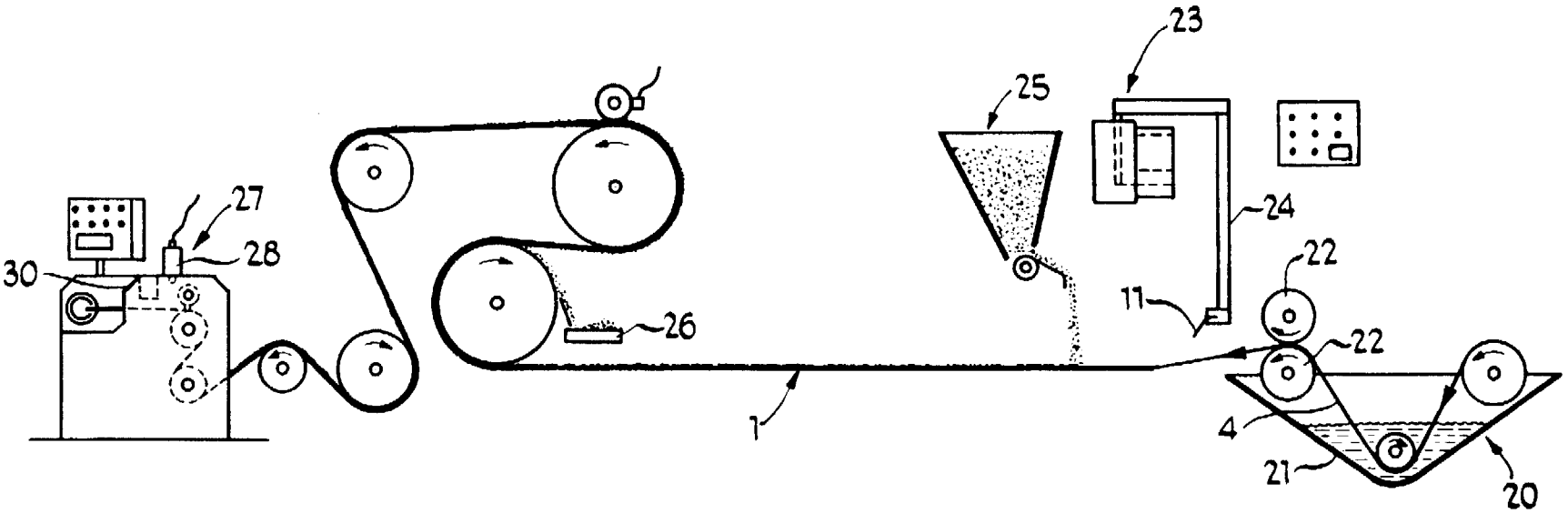
FIG. 1 schematically illustrates the front view of the processing system.
Figure 2:
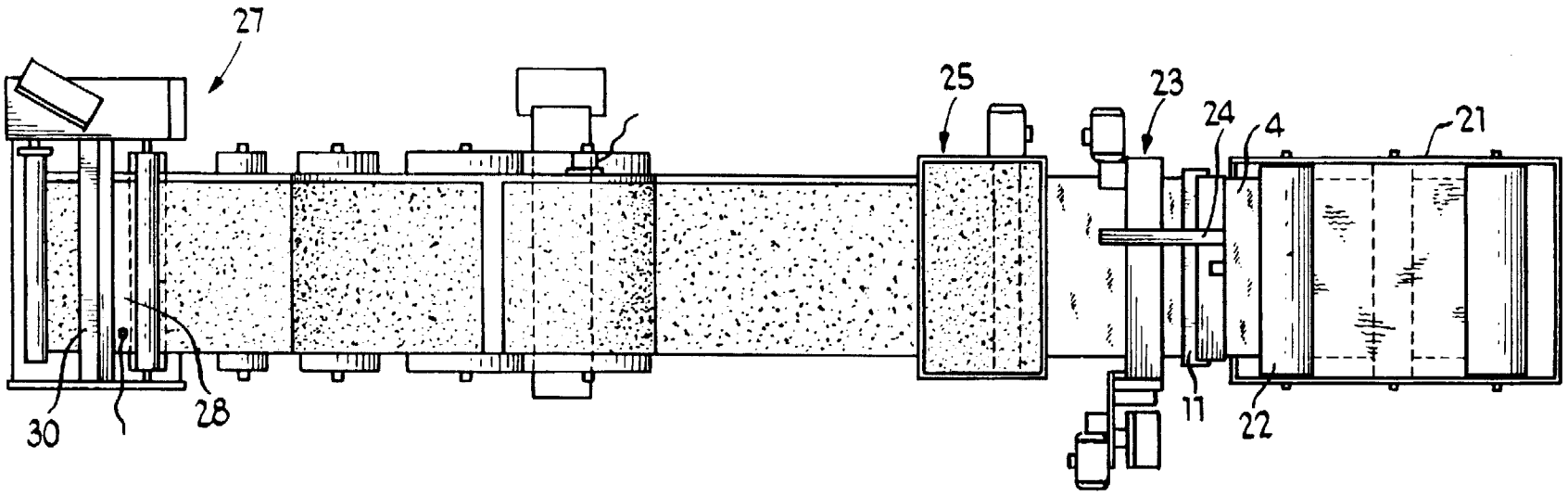
FIG. 2 illustrates the plan view of the processing system.

FIGS. 1 and 2, in particular, show the system that has been specially set up for obtaining membranes with transverse selvage, as described above.

The system includes a soaking station, reference number 20. The reinforcement cloth 4—made of a thin layer of reinforced glass or of polyester non-woven cloth—goes first through this soaking tub 21, then through rotary presses 22, which determine the final thickness of the product.

Immediately downstream from rotary presses 22 is the tape application group 23. This group—equipped with a cutter—prepares the silicon polyester tapes 11.

Group 23 is also equipped with a positioning arm 24, which positions the tapes in their appropriate location.

In this way, the automated arm can position the tape, with very high precision, on the surface of the membrane.

Once the tape is positioned in its location, the reinforcing material 4, which is soaked with bitumen, travels underneath the granule distribution machine 25. This machine uniformly distributes granular material—in a preset quantity—on the still warm surface of the membrane in order to appropriately protect said surface.

Next, the membrane sheet 1 goes through a reclamation setup 26 which recovers any excess granules.

At this point, the membrane sheet is guided to the rolling device 27 where notch detector 28 is located. The notch detector reads the notch on the tape and sends a signal to the control board.

The control board instructs the cutter 30 to cut the sheet/slab-like element at the end of the granule coated surface and immediately before the silicon polyester tape.

At this point, the membrane is rolled up, sealed with tape, delivered onto a pallet, covered with shrink-wrap polyethylene, fed through the shrink-wrap oven and finally sent to storage.

Because of the above procedure, the transverse selvage is located inside the turns of the rolled membrane.

For this reason, at installation it is sufficient to unroll the membrane, remove the silicon polyester protective tape 11 and, after unrolling the second roll, weld the leading edge of this roll on the transverse selvage. This is an extremely fast and simple procedure that produces perfect couplings.

The above descriptions and explanations demonstrate that the invention achieves the set goals.

In particular, it is necessary to stress the fact that accomplishing a bitumen-based membrane, with at least one transverse selvage, on one of its ends, makes it possible to extremely simplify all the installation steps as well as the coupling procedures with contiguous membranes.

The herein described invention, so devised, can have modifications and variants applied to it, which are not beyond the scope of the protection of this invention.

Also, any detail can be substituted with other elements that are technically equivalent.

Practically, one can use any material—provided that it is compatible with the specific application—as well as any dimensions and relevant shapes, according to the requirements.

What is claimed:

1. A bitumen-based membrane sheet provided in a roll having a longitudinal direction and provided with means for providing an effective and reliable seal between contiguous membranes, the membrane comprising:

a bitumen-based, fiber-reinforced membrane sheet, the membrane sheet including two sides, one side of the membrane sheet being coated with granular material, the membrane sheet further including two edges, one edge of the membrane sheet including a selvage consisting of a tract of exposed bitumen which is free of granular material, the edge including the selvage being transverse to the longitudinal direction of the roll.

2. The membrane sheet of claim 1, wherein the membrane sheet is reinforced with polyester non-woven cloth.

3. The membrane sheet of claim 1, wherein the membrane sheet is reinforced with fiber glass.

4. The membrane sheet of claim 1, wherein the granular material comprises small slate flakes.

5. The membrane sheet of claim 1, wherein the selvage is covered with a removable protective material.

6. The membrane sheet of claim 5, wherein the selvage is covered with protective tape.

7. The membrane sheet of claim 1, wherein the selvage is of a constant width.

8. The membrane sheet of claim 6, wherein the protective tape is siliconized polyester.

* * * * *